United States Patent [19]

Brunkan

[11] Patent Number: 4,899,991

[45] Date of Patent: Feb. 13, 1990

[54] FENCE PANEL BRACKET

[75] Inventor: B. J. Brunkan, Memphis, Tenn.

[73] Assignee: Hackney Wholesale, Memphis, Tenn.

[21] Appl. No.: 349,047

[22] Filed: May 8, 1989

[51] Int. Cl.[4] ..... E04H 17/14

[52] U.S. Cl. ..... 256/69; 256/55; 256/24; 256/65

[58] Field of Search ..... 256/24, 27, 31, 65, 256/68, 73, DIG. 4, 69, 55

[56] References Cited

U.S. PATENT DOCUMENTS

| | | | |
|---|---|---|---|
| 365,099 | 6/1887 | Richart . | |
| 799,595 | 9/1905 | Drewke . | |
| 900,545 | 10/1908 | Humiston . | |
| 1,840,048 | 1/1932 | Michelman . | |
| 1,950,965 | 3/1934 | Blackburn | 287/54 |
| 2,930,638 | 3/1960 | Morrissey | 287/54 |
| 3,524,627 | 8/1970 | Boyanton et al. | 256/65 |
| 3,747,898 | 7/1973 | Warren | 256/59 |
| 3,989,226 | 11/1976 | Burgess | 256/65 |
| 4,078,772 | 3/1978 | Carbone | 256/24 |
| 4,280,686 | 7/1981 | Wack | 256/65 |
| 4,471,947 | 9/1984 | Osborne | 256/24 |

*Primary Examiner*—Andrew V. Kundrat
*Attorney, Agent, or Firm*—Walker & McKenzie

[57] ABSTRACT

A bracket for use in combination with clamp structure for securing the bracket to a fence post and fastener structure for securing the bracket to a fence assembly. The bracket includes body structure for being fastened to the fence assembly by the fastener structure, the body structure has a face panel for being positioned adjacent to the fence assembly. The face panel has first and second slots therethrough and has bridge portions adjacent to the ends of the first and second slots. The clamp structure includes a ring portion for extending about the fence post and through at least one of the slots and about at least one of the bridge protions of the face panel of the body structure of the bracket to secure the fence post to the bracket.

18 Claims, 3 Drawing Sheets

FENCE PANEL BRACKET

BACKGROUND OF THE INVENTION

1. Field of the Invention

The present invention relates, in general, to a bracket for use in securing fence panels to fence posts or to other fence panels.

2. Information Disclosure Statement

A preliminary patentability search in class 256, subclasses 65, 68 and 69 produced the following patents which relate to various fence contructions and may, therefore, be relevant to the present invention: Osborne, U.S. Pat. No. 4,471,947; Carbone, U.S. Pat. No. 4,078,772; Burgess, U.S. Pat. No. 3,989,226; Warren, U.S. Pat. No. 3,747,898; Boyanton et al, U.S. Pat. No. 3,524,627; Morrissey, U.S. Pat. No. 2,930,638; Blackburn, U.S. Pat. No. 1,950,965; Michelman, U.S. Pat. No. 1,840,048; Humiston, U.S. Pat. No. 900,545; Drewke, U.S. Pat. No. 799,595; and Richart, U.S. Pat. No. 365,099. None of the above patents disclose or suggest the present invention. For example, none of the above patents disclose or suggest a bracket including body means for being fastened to a fence assembly, the body means having a face panel for being positioned adjacent to the fence assembly, the face panel having first and second slots therethrough and having bridge portions adjacent to the ends of the first and second slots, and clamp means including a ring portion for extending about a fence post and through at least one of the slots and about at least one of the bridge portions of the face panel of the body means of the bracket to secure the fence post to the bracket. The Boyanton, Osborne, Morrissey, Carbone, Warren, Blackburn and Humiston brackets would require another complete assembly to fit a different diameter round or different dimensioned square or rectangular post rather than a different but readily available brace band.

SUMMARY OF THE INVENTION

The present invention is directed toward providing improved means for connecting a fence panel to a fence post or to another fence panel. The concept of the present invention is to provide a bracket of superior quality that can be attached to typical wood fence panels and to any size or type fence post.

The bracket of the present invention is for use in combination with clamp means for securing the bracket to a fence post and fastener means for securing the bracket to a fence assembly. The bracket includes body means for being fastened to the fence assembly by the fastener means, the body means has a face panel for being positioned adjacent to the fence assembly. The face panel has first and second slots therethrough and has bridge portions adjacent to the ends of the first and second slots. The clamp means includes a ring portion for extending about the fence post and through the at least one of the slots and about at least one of the bridge portions of the face panel of the body means of the bracket to secure the fence post to the bracket.

The present invention provides a universal bracket that can be used as a line post fastener bracket (see FIGS. 2 and 9), a corner post fastener bracket (see FIG. 7), a gate post fastener bracket (see FIG. 6) with the bracket completely removed from the gate hinge area by the brace band placement through the end of the bracket rather than the middle of the bracket to thereby offer no obstruction to the hinging of the gate, or a wood joiner (see FIGS. 5 and 10) to join two 2×4's together (other than at a line post connection) when replacing rotten segments of 2×4's in the middle of a fence or when adding lengths of 2×4's to existing 2×4's to cover distances between fence posts. The universal bracket can be used with almost any standard post with conventional brace bands manufactured by fence manufacturers and used for top rail attachment, etc.

DESCRIPTION OF THE PREFERRED EMBODIMENT

Figure 1:
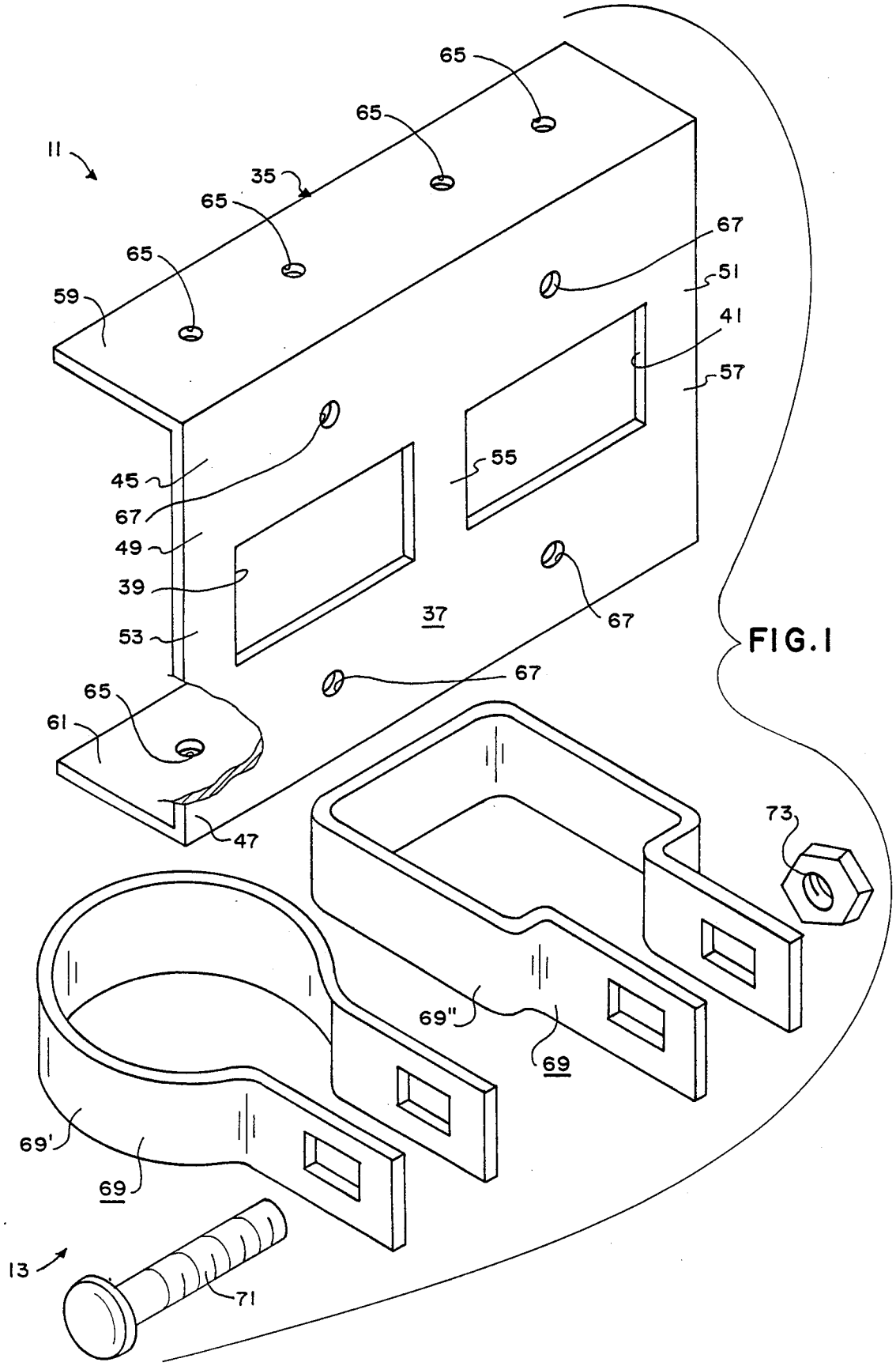
FIG. 1 is an exploded perspective view of a first embodiment of the bracket of the present invention and a plurality of clamp means for use therewith.

A first embodiment of the bracket of the present invention is shown in FIGS. 1–7 and identified by the numeral 11. The bracket 11 is for use in combination with clamp means 13 for securing the bracket 11 to a fence post 15 and fastener means 17 for securing the bracket 11 to a fence assembly 19. The fence post 15 is preferably a typical metal fence post of various cross section shapes and sizes as will now be apparent to those skilled in the art. The fence post 15 shown in the drawings is circular in cross sectional with a diameter of $1\frac{3}{8}$ inches, $1\frac{5}{8}$ inches, $2\frac{3}{8}$ inches, $1\frac{5}{8}$ inches, $1\frac{7}{8}$ inches, $2\frac{3}{8}$ inches, $2\frac{7}{8}$ inches, $3\frac{1}{2}$ inches, 4 inches, $4\frac{1}{2}$ inches, $6\frac{5}{8}$ inches, or $8\frac{5}{8}$ inches. However, the fence post 15 may also be square, rectangular, C-shaped, H-shaped, etc., in cross section without departing from the spirit and scope of the present invention. Thus, the fence post 15 may be a well-known junior or senior H-beam post having a cross sectional size of 1.875 inches by 1.625 inches or 1.875 inches by 2.25 inches, or may consist of well known C post having a cross section size of 1.875 inches by 2.25 inches, 1.875 inches by 1.625 inches, or $2\frac{3}{8}$ inches by $1\frac{3}{4}$ inches as will now be apparent to those skilled in the art. The fence assembly 19 is preferably constructed out of wood in any specific manner now apparent to those skilled in the art. Thus, the fence assembly 19 preferably includes a fence panel 21 consisting of a plurality of wood planks or the like, and preferably includes a first support beam 23 secured to the fence panel 21 by nails or the like in a position substantially transverse to the direction of the planks. The fence assembly 19 preferably includes at least a second support beam (not shown) secured to the fence panel 21 by nails or the like in a position substantially transverse to the direction of the planks and at a spaced location from the first support beam 23 as will now be apparent to those skilled in the art. Each support beam 23 may consist of standard dimensioned lumber such as a "2 by 4". Each support beam 23 preferably has a face side 27, a top edge 29, a bottom edge 31, and a rear side 33 with the face and rear sides 27, 33 parallel to one another and perpendicular to the top and bottom edges 29, 31.

The bracket 11 includes body means 35 for being fastened to the fence assembly 19 by the fastener means 17. The body means 35 includes a face panel 37 for being positioned adjacent to the fence assembly 19. The face panel 37 has a first slot 39 therethrough, a second slot 41 therethrough, and bridge portions adjacent to the ends of the first and second slots 39, 41. More specifically, the face panel 37 preferably has a top edge 45, a bottom edge 47, a first side edge 49, a second side edge 51, a first bridge portion 53 separating the first side edge 49 and the first slot 39, a second bridge portion 55 separating the first and second slots 39, 41, and a third bridge portion 57 separating the second slot 41 and the second side edge 51 as clearly shown in FIG. 1.

The body means 35 of the bracket 11 preferably includes a top flange 59 joined to the face panel 37 of the body means 35 adjacent to the top edge 45 thereof for engaging the top edge 29 of a support beam 23 and preferably includes a bottom flange 61 joined to the face panel 37 of the body means 35 adjacent to the bottom edge 47 thereof for engaging the bottom edge 31 of a support beam 23. The face panel 37 is preferably positioned adjacent to the face side 27 of a support beam 23 with a slight space therebetween. The flanges 59, 61 may have about a 15 degree cant to fit a swollen or out-of-square support beam 23 as will now be apparent to those skilled in the art.

The fastener means 17 may include a plurality of nails or the like. The top and bottom flanges 59, 61 of the body means 35 of the bracket 11 preferably have a plurality of apertures 65 therethrough for allowing the nails or the like to extend therethrough to fasten the bracket 11 to a support beam 23 as will now be apparent to those skilled in the art. The face panel 37 of the body means 35 of the bracket 11 also preferably has a plurality of apertures 67 therethrough for allowing the nails or the like to extend therethrough to fasten the bracket 11 to a support beam 23. It should be noted that the fastener means 17 may include lag screws and/or bolt means (not shown) instead of or in addition to nails.

The bracket 11 is preferably constructed as an integral, one-piece unit out of metal in any specific manner now apparent to those skilled in the art such as by being bent out of galvanized steel plates or the like with the slots 39, 41 and apertures 65, 67 punched and/or drilled therethrough.

The clamp means 13 preferably includes a band or ring portion 69 for extending about the fence post 15 and through at least one of the slots 39, 41 and about at least one of the bridge portions 53, 55, 57 of the face panel 37 of the body means 35 of the bracket 11 to secure the fence post 15 to the bracket 11 as clearly shown in FIGS. 2, 3, 4, 6 and 7. The specific size and shape of the ring portion 69 depends on the specific size and shape of the fence post 15 used. FIG. 1 shows a pair of different shaped conventional ring portions 69', 69'' for use with different shaped fence posts, etc. Other various shaped conventional ring portions 69 may be used in the present invention as will now be apparent to those skilled in the art. The clamp means 13 also preferably includes a bolt member 71 and a nut member 73 for clamping the ring portion 69 about a bridge portion 53, 55, 57 and a fence post 15 as will now be apparent to those skilled in the art. The clamp means 13 preferably consist of a conventional brace band manufactured by fence manufacturers in various sizes and shapes used for top rail attachment, etc., as will now be apparent to those skilled in the art. The specific clamp means 13 used depends on the specific fence post 15.

Figure 2:
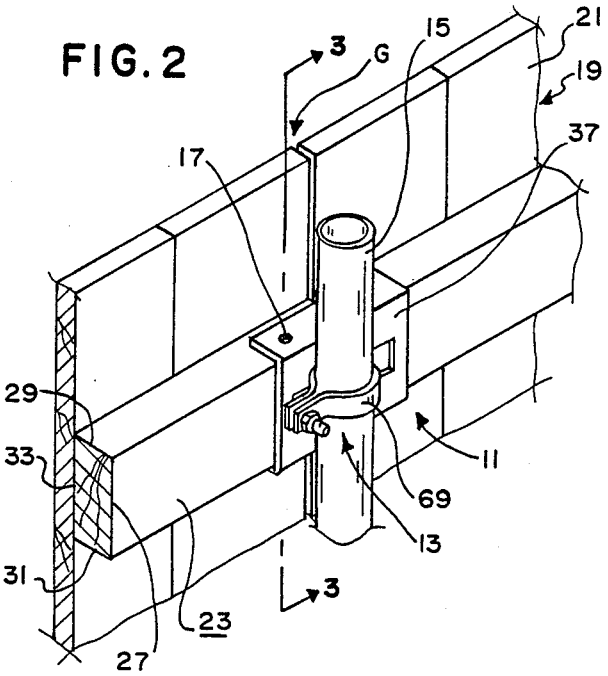
FIG. 2 is a perspective view of the bracket of FIG. 1 shown connecting two fence panels or assemblies to a fence post.
Figure 3:
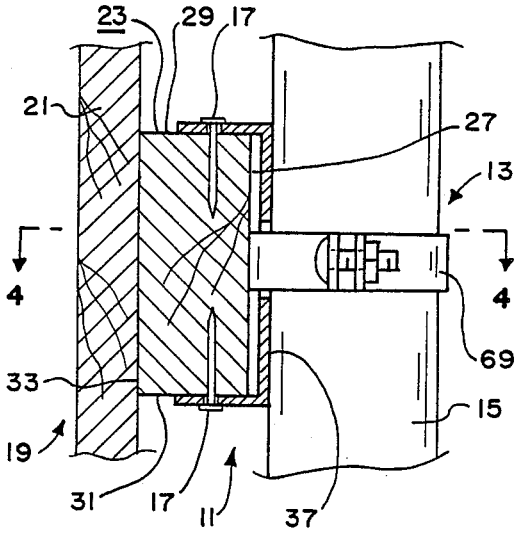
FIG. 3 is an enlarged sectional view substantially as taken on line III—III of FIG. 2.
Figure 4:
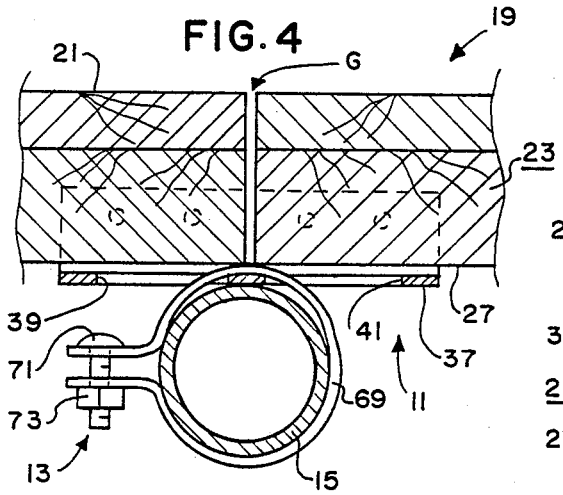
FIG. 4 is a sectional view substantially as taken on line IV—IV of FIG. 3.
Figure 5:
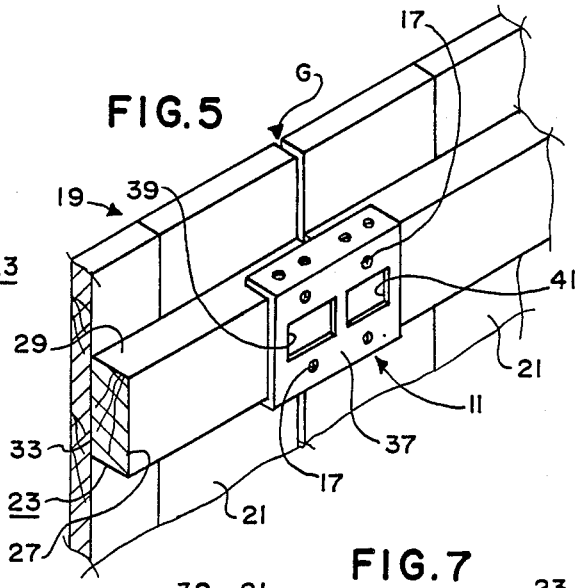
FIG. 5 is a perspective view of the bracket of the bracket of FIG. 1 shown connecting two fence panels or assemblies to one another.
Figure 6:
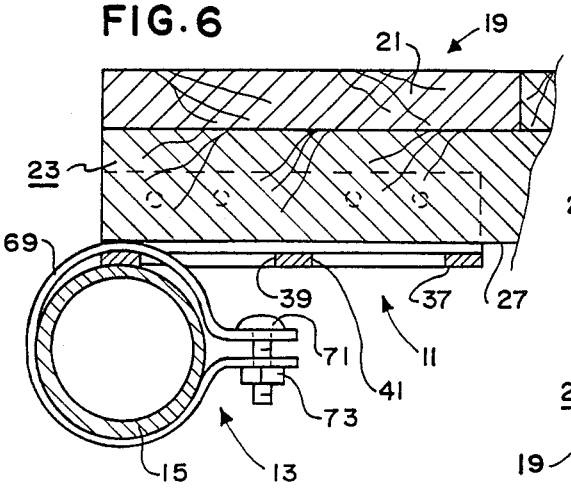
FIG. 6 is a sectional view similar to FIG. 4 but showing the bracket of the present invention attaching the end of a fence assembly to a fence gate post.
Figure 7:
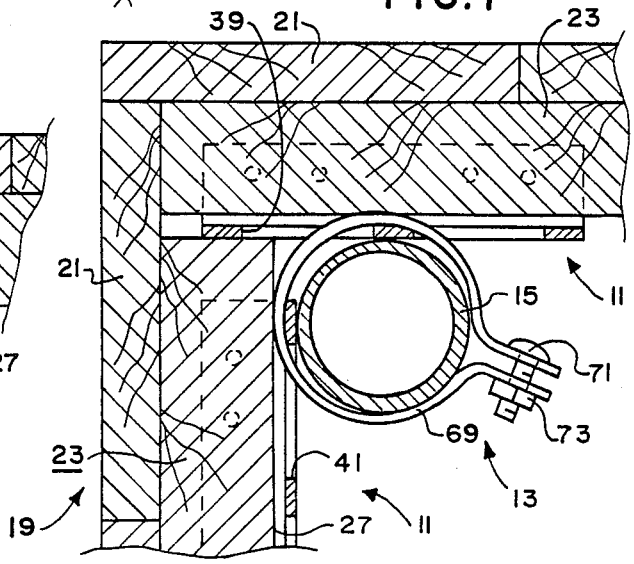
FIG. 7 is a sectional view similar to FIG. 4 but showing the bracket of the present invention attaching a pair of fence panels or assemblies to a corner fence post.

The bracket 11 can be used to connect one or more fence panels 21 to a fence post 15 as clearly shown in FIGS. 2, 3, 4, 6 and 7 or to merely join two adjacent to fence panels 21 to one another as clearly shown in FIG. 5. A gap G is typically provided between the ends of the fence panels 21. FIGS. 2, 3 and 4 shows the bracket 11 used in combination with a clamp means 13 to secure the ends of a pair of fence panels 21 to one another and to a fence post 15 between each face panel 21. FIG. 6 shows the bracket 11 used in combination with a clamp means 13 to secure the end of a fence panel 21 to a fence post 15 which might also be used as a gate post or the like as will now be apparent to those skilled in the art. FIG. 7 shows a pair of brackets 11 used in combination with a clamp means 13 to join two fence panels 21 to a corner fence post 15.

Figure 8:
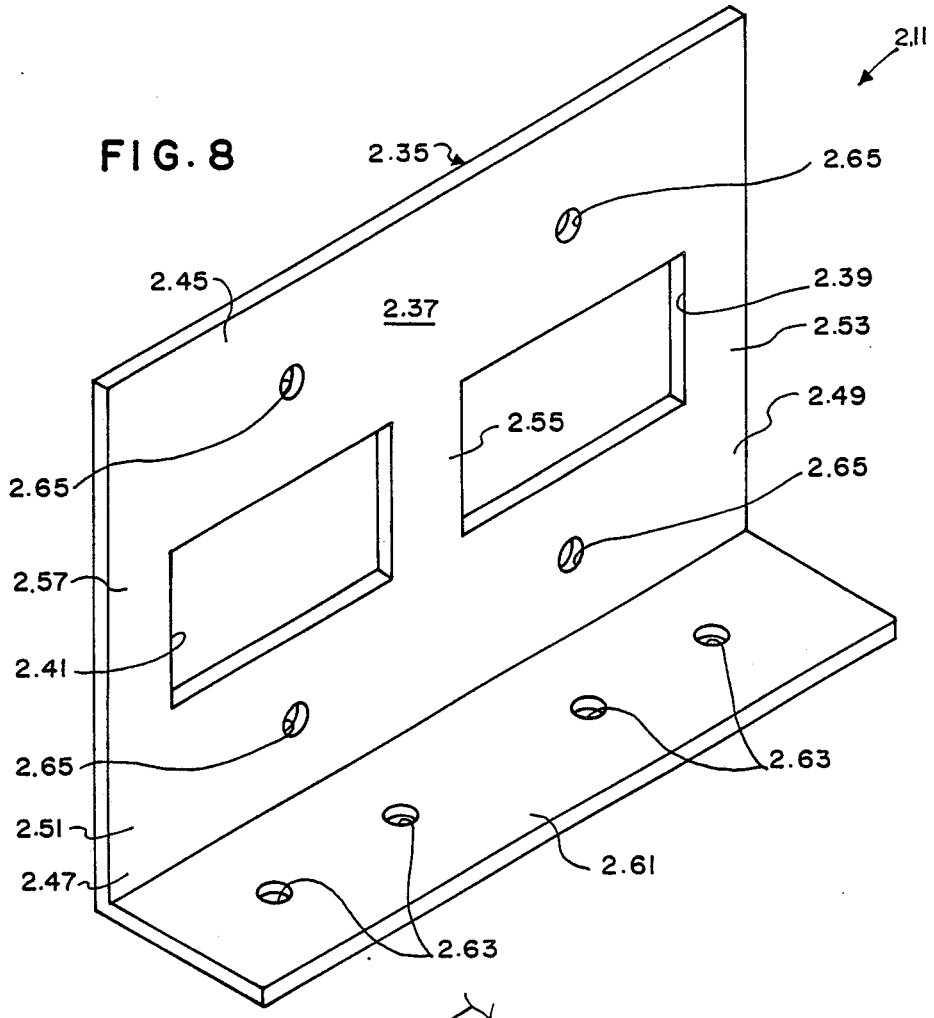
FIG. 8 is a perspective view of a second embodiment of the bracket of the present invention.
Figure 9:
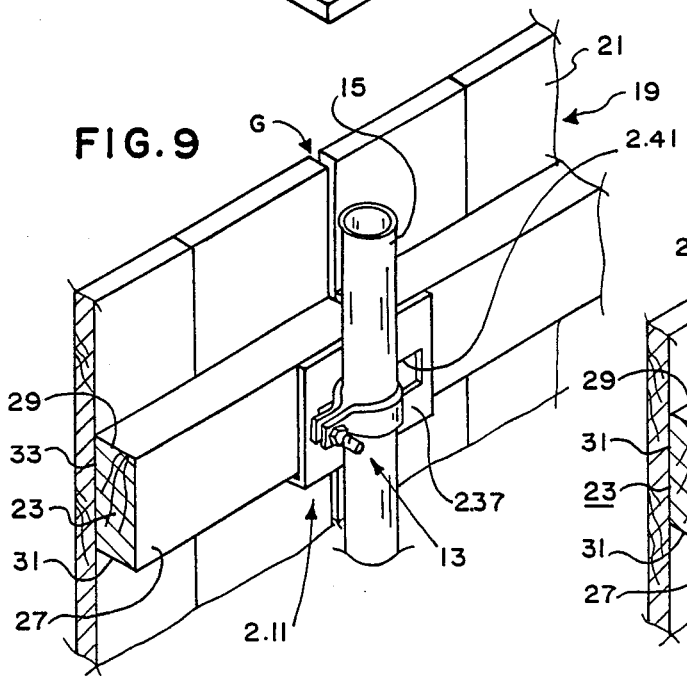
FIG. 9 is a perspective view of the bracket of FIG. 8 shown connecting two fence panels or assemblies to a fence post.
Figure 10:
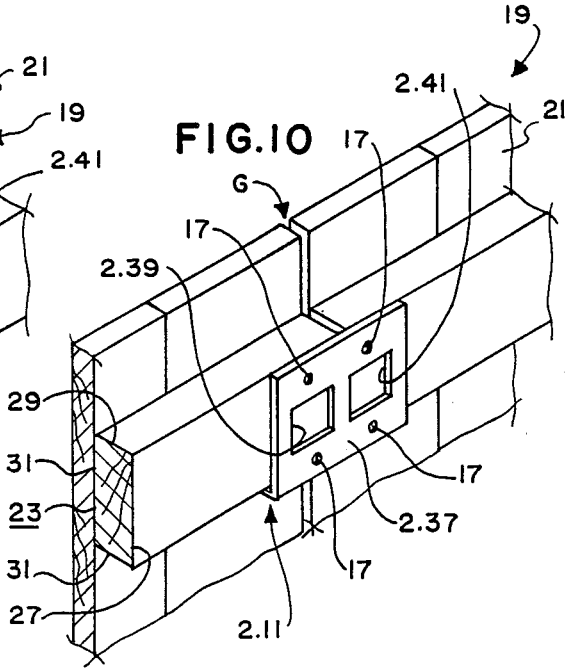
FIG. 10 is a perspective view of the bracket of FIG. 8 shown connecting two fence panels or assemblies to one another.

A second embodiment of the bracket of the present invention is shown in FIGS. 8–10 and identified by the numeral 2.11. The difference between the first and second embodiments of the present invention is that the second embodiment does not include a flange 35 and is not, therefore, limited in the size of support beams that can be used with any specific size thereof. The function and purpose of the bracket 2.11 is the same as the function and purpose of the bracket 11 and reference to the above description of the bracket 11 should be made for a more complete understanding of the function and purpose of the bracket 2.11.

The bracket 2.11 includes body means 2.35 for being fastened to the fence assembly 19 by the fastener means 17. The body means 2.35 includes a face panel 2.37 for being positioned adjacent to the fence assembly 19. The face panel 2.37 has a first slot 2.39 therethrough, a second slot 2.41 therethrough, and bridge portions adjacent to the ends of the first and second slots 2.39, 2.41. More specifically, the face panel 2.37 preferably has a top edge 2.45, a bottom edge 2.47, a first side edge 2.49, a second side edge 2.51, a first bridge portion 2.53 separating the first side edge 2.49 and the first slot 2.39, a second bridge portion 2.55 separating the first and second slots 2.39, 2.41 and a third bridge portion 2.57 separating the second slot 2.41 and the second side edge 2.51 as clearly shown in FIG. 8.

The body means 2.35 of the bracket 11 preferably includes a bottom flange 2.61 joined to the face panel 2.37 of the body means 2.35 adjacent to the bottom edge 2.47 thereof for engaging the bottom edge 31 of a support beam 23. The face panel 2.37 is preferably positioned adjacent to the face side 27 of a support beam 23 with a slight space therebetween. The flange 2.61 may have about a 15 degree cant to fit a swollen or out-of-square support beam 23 as will now be apparent to those skilled in the art.

The bottom flange 2.61 of the body means 2.35 of the bracket 2.11 preferably has a plurality of apertures 2.63 therethrough for allowing the nails or the like of the fastener means 17 to extend therethrough to fasten the bracket 2.11 to a support beam 23 as will now be apparent to those skilled in the art. The face panel 2.37 of the body means 2.35 of the bracket 2.11 also preferably has a plurality of apertures 2.65 therethrough for allowing the nails or the like to extend therethrough to fasten the bracket 2.11 to a support beam 23.

The bracket 2.11 is preferably constructed as an integral, one-piece unit out of metal in any specific manner now apparent to those skilled in the art such as by being bent out of galvanized steel plates or the like with the slots 2.39, 2.41 and apertures 2.65, 2.63 punched, machined and/or drilled therethrough.

Any of the conventional clamp means 13 discussed hereinabove with respect to the bracket 11 may also be used with the bracket 2.11 to secure the fence post 15 to the bracket 2.11 as clearly shown, for example, in FIG. 9.

The bracket 2.11 can be used to connect one or more fence panels 21 to an in-line fence post 15 as clearly shown, for example, in FIG. 9, or to a corner fence post or a gate post as disclosed hereinabove with respect to the bracket 11, or to merely join two adjacent to fence panels 21 to one another as clearly shown in FIG. 10, all regardless of the size of the support beam 23 (e.g., whether the support beam 23 is a conventional 2 by 4, 2 by 6, etc.) as will now be apparent to those skilled in the art. A gap G is typically provided between the ends of the fence panels 21.

As thus constructed and used, the present invention provides a universal bracket that can be used to attach conventional wood fence panels or assemblies to any type metal fence post or the like using conventional brace bands manufactured by fence manufacturing companies and the like, and that can be used as a joiner to join two fence panels or assemblies together.

Although the present invention has been described and illustrated with respect to a preferred embodiment and a preferred use therefor, it is not to be so limited since modifications and changes can be made therein which are within the full intended scope of the invention.

I claim:

1. A bracket for use in combination with clamp means for securing said bracket to a fence post and fastener means for securing said bracket to a fence assembly; said bracket comprising: body means for being fastened to said fence assembly by said fastener means, said body means including a face panel for being positioned adjacent to said fence assembly, said face panel having first and second slots therethrough and having bridge portions adjacent to the ends of said first and second slots; said clamp means including a ring portion for extending about said fence post and through said at least one of said slots and about at least one of said bridge portions of said face panel of said body means of said bracket to secure said fence post to said bracket.

2. The bracket of claim 1 in which said fence assembly includes a fence panel and at least one support beam secured to said fence panel, said support beam having a face side and a bottom edge; in which said face panel of said body means of said bracket has a bottom edge and is positioned adjacent to said face side of said support beam; and in which said body means of said bracket includes a bottom flange joined to said face panel of said body means adjacent to said bottom edge thereof for engaging said bottom edge of said support beam.

3. The bracket of claim 2 in which said support beam has a top edge; in which said face panel of said body means of said bracket has a top edge; and in which said body means of said bracket includes a top flange joined to said face panel of said body means adjacent to said top edge thereof for engaging said top edge of said support beam.

4. The bracket of claim 3 in which said top and bottom flanges of said body means of said bracket have a plurality of apertures therethrough for allowing said fastener means to extend therethrough to fasten said bracket to said support beam.

5. The bracket of claim 4 in which said face panel of said body means of said bracket has a plurality of apertures therethrough for allowing said fastener means to extend therethrough to fasten said bracket to said support beam.

6. The bracket of claim 5 in which said bracket is constructed as an integral, one-piece unit out of metal.

7. A universal bracket for use in combination with one of any conventional clamp means for securing said bracket to a fence post for which said clamp means is sized, said clamp means including a ring portion for extending about said fence post, and with fastener means for securing said bracket to a fence assembly; said fence assembly including a fence panel and at least one support beam secured to said fence panel, said support beam having a face side and a bottom edge; said bracket comprising: body means for being fastened to said fence assembly by said fastener means, said body means including a face panel for being positioned adjacent to said face side of said support beam of said fence assembly; said face panel having a bottom edge, a first side edge, and a second side edge; said face panel having first and second slots therethrough and having a first bridge portion separating said first side edge and said first slot, having a second bridge portion separating said first and second slots, and having a third bridge portion separating said second slot and said second side edge; said ring portion of said clamp means being capable of extending about said fence post and through said at least one of said slots and about at least one of said bridge portions of said face panel of said body means of said bracket to secure said fence post to said bracket.

8. The bracket of claim 7 in which said body means of said bracket includes a bottom flange joined to said face panel of said body means adjacent to said bottom edge thereof for engaging said bottom edge of said support beam.

9. The bracket of claim 8 in which said support beam has a top edge; in which said face panel of said of said body means has a top edge; in which said body means of said bracket includes a top flange joined to said face panel of said body means adjacent to said top edge thereof for engaging said top edge of said support beam.

10. The bracket of claim 9 in which said top and bottom flanges of said body means of said bracket have a plurality of apertures therethrough for allowing said fastener means to extend therethrough to fasten said brackaet to said support beam.

11. The bracket of claim 10 in which said face panel of said body means of said bracket has a plurality of apertures therethrough for allowing said fastener means to extend therethrough to fasten said bracket to said support beam.

12. The bracket of claim 11 in which said bracket is constructed as an integral, one-piece unit out of metal.

13. An apparatus for connecting a wood fence assembly to a metal fence post; said fence assembly including a wood fence panel, a first horizontal wood support beam, and a second horizontal wood support beam; each of said support beams having a face side, a top edge extending at a right angle from said face side, and a bottom edge extending at a right angle from said face side; said apparatus comprising, in combination:

(a) a plurality of fastener means;

(b) a first bracket for being fixedly attached to said first horizontal wood support beam, said first bracket including body means for being fastened to said fence assembly by one or more of said fastener means, said body means including a face panel for being positioned adjacent to said face side of said first horizontal wood support beam of said fence assembly; said face panel having a top edge, a bottom edge, a first side edge, and a second side edge; said face panel having first and second slots therethrough and having a first bridge portion separating said first side edge and said first slot, having a second bridge portion separating said first and second slots, and having a third bridge portion separating said second slot and said second side edge;

(c) first clamp means for securing said first bracket to said fence post; said first clamp means including a ring portion for extending about said fence post and through said at least one of said slots and about at least one of said bridge portions of said face panel of said body means of said first bracket to secure said fence post to said first bracket;

(d) a second bracket for being fixedly attached to said second horizontal wood support beam, said second bracket including body means for being fastened to said fence assembly by one or more of said fastener means, said body means including a face panel for being positioned adjacent to said face side of said second horizontal wood support beam of said fence assembly; said face panel having a top edge, a bottom edge, a first side edge, and a second side edge; said face panel having first and second slots therethrough and having a first bridge portion separating said first side edge and said first slot, having a second bridge portion separating said first and second slots, and having a third bridge portion separating said second slot and said second side edge; and (e) second clamp means for securing said second bracket to said fence post; said second clamp means including a ring portion for extending about said fence post and through said at least one of said slots and about at least one of said bridge portions of said face panel of said body means of said second bracket to secure said fence post to said second bracket.

14. The apparatus of claim 13 in which said body means of said first bracket includes a bottom flange joined to said face panel of said body means adjacent to said bottom edge thereof for engaging said bottom edge of said first support beam; and in which said body means of said second bracket includes a bottom flange joined to said face panel of said body means adjacent to said bottom edge thereof for engaging said bottom edge of said second support beam.

15. The apparatus of claim 14 in which said body means of said first bracket includes a top flange joined to said face panel of said body means adjacent to said top edge thereof for engaging said top edge of said first support beam; and in which said body means of said second bracket includes a top flange joined to said face panel of said body means adjacent to said top edge thereof for engaging said top edge of said second support beam.

16. The apparatus of claim 15 in which said top and bottom flanges of said body means of said first and second brackets have a plurality of apertures therethrough for allowing said fastener means to extend therethrough to fasten said first and second brackets to said first and second support beam.

17. The apparatus of claim 16 in which said face panel of said body means of said first and second brackets have a plurality of apertures therethrough for allowing said fastener means to extend therethrough to fasten said first and second brackets to said first and second support beam.

18. The apparatus of claim 17 in which said first bracket is constructed as an integral, one-piece unit out of metal and in which said second bracket is constructed as an integral, one-piece unit out of metal.

* * * * *